United States Patent [19]

da Silva Antunes

[11] Patent Number: 4,941,555

[45] Date of Patent: Jul. 17, 1990

[54] ELECTRIC MONORAIL CONVEYOR

[75] Inventor: Eloy da Silva Antunes, Dillingen, Fed. Rep. of Germany

[73] Assignee: Seiwert Stahl- und Apparatebau GmbH, Dillingen, Fed. Rep. of Germany

[21] Appl. No.: 223,546

[22] Filed: Jul. 22, 1988

[30] Foreign Application Priority Data

Jul. 25, 1987 [DE] Fed. Rep. of Germany ..... 3724763

[51] Int. Cl.[5] ..... B60L 15/00; B60M 1/00

[52] U.S. Cl. ..... 191/14; 191/6; 104/295; 104/298; 246/31

[58] Field of Search ..... 191/3, 5, 6, 14, 29 R, 191/290 M; 104/298, 295; 246/31, 32, 57, 61, 86, 179

[56] References Cited

U.S. PATENT DOCUMENTS

| | | | |
|---|---|---|---|
| 3,687,082 | 8/1972 | Burke, Jr. | 104/298 |
| 3,874,301 | 4/1975 | Alimanestianu | 104/298 |
| 4,665,831 | 5/1987 | Matsui et al. | 104/298 |
| 4,688,487 | 8/1987 | Dollens et al. | 104/298 |
| 4,792,885 | 12/1988 | Cuman et al. | 363/56 |
| 4,803,722 | 2/1989 | Schreiber | 363/20 |

*Primary Examiner*—Andres Kashnikow
*Assistant Examiner*—Christopher G. Trainor
*Attorney, Agent, or Firm*—Peter K. Kontler

[57] ABSTRACT

An electric monorail conveyor wherein the vehicles are suspended from and advance along an elongated guide rail. The electric motor of each vehicle receives current from a third rail which is adjacent the guide rail and includes first sections alternating with second sections at locations where the vehicles are to be brought to a halt. The second sections are galvanically separated from the first sections and receive low-frequency current from a frequency converter which can reduce the frequency when the motor of a vehicle is electrically connected with a second section. This renders it possible to arrest the vehicles in predetermined positions with a tolerance of not more than ±2 mm. The first sections of the third rail are connected with a source of higher-frequency current, and a follower of each vehicle is electrically connected with the third rail as well as with the respective motor so that an arrested vehicle can be rapidly accelerated from zero speed to full speed while it receives current from a first section of the third rail by way of the corresponding follower.

3 Claims, 1 Drawing Sheet

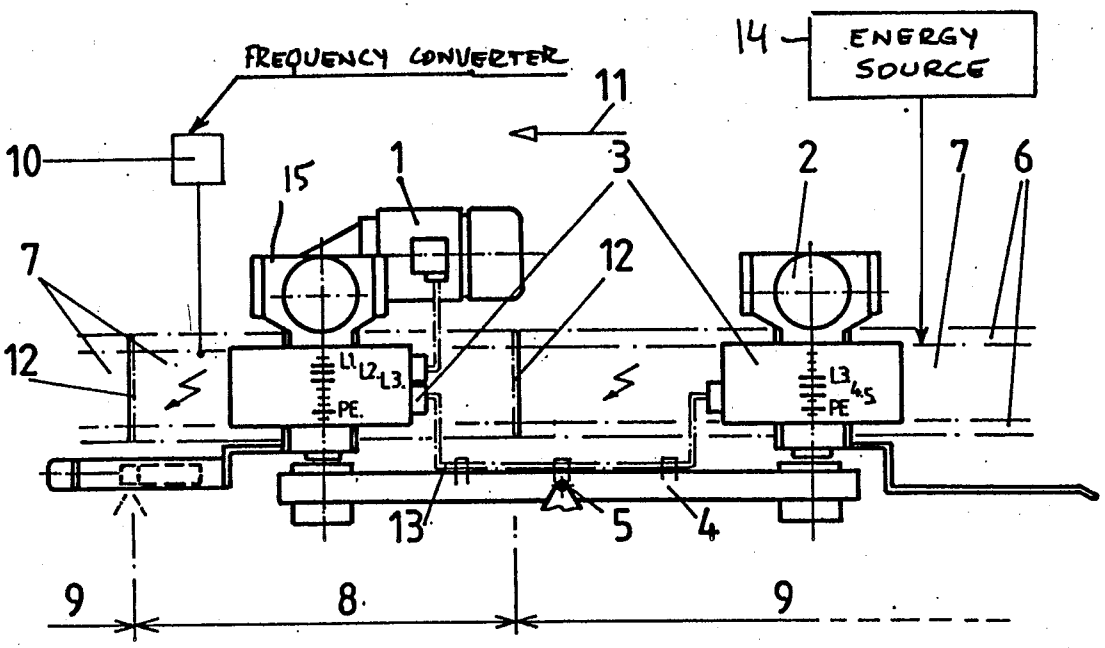
ENERGY SOURCE
FREQUENCY CONVERTER
L1
L2
L3
PE
L3
4,5
PE
1
2
3
4
5
6
7
8
9
9
10
11
12
12
13
14
15

ELECTRIC MONORAIL CONVEYOR

BACKGROUND OF THE INVENTION

The invention relates to electrically operated conveyors in general, and more particularly to improvements in electric monorail conveyors of the type wherein the electric motor or motors of one or more vehicles contact a third rail or live rail and the vehicle or vehicles are confined to travel along one or more guide members, e.g., along one or more overhead rails in an assembly plant for motor vehicles.

A drawback of many presently known electric conveyors is that their vehicles cannot be arrested in accurately determined positions which are best suited for the placing of a load onto a decelerated and arrested vehicle or for removal of a portion of or the entire load from a vehicle which is about to be accelerated. The load can be removed for the purpose of assembling it with other parts in the production or assembly line, for transfer onto another conveyor or for treatment prior to assembly with other parts. It is desirable to rapidly accelerate the vehicles from zero speed to maximum speed as well as to rapidly decelerate oncoming vehicles for stoppage at an accurately determined location in an assembly plant or the like.

Vehicles which are equipped with electric motors consuming polyphase current cannot be arrested with less than a tolerance of approximately ±20 mm which is well beyond the acceptable range in many assembly plants. This is due to the fact that such motors operate within a certain RPM range which is not conducive to rapid and predictable braking.

It is also known to equip the vehicles (also called trolleys) of electric conveyors with changeablepole electric motors. This renders it possible to reduce the RPM of the motor while the vehicle approaches a load applying or a load receiving station. Such motors can ensure that the range of tolerances is reduced well below ±20 mm; however, the braking action is still unsatisfactory for a number of purposes. Furthermore, drive means employing changeable-pole motors are expensive and their control circuits are too complex and too costly for a large number of applications. The situation is aggravated if a plant employs a large number of conveyors or a conveyor system with a large number of vehicles.

Accurate positioning of vehicles at the loading, unloading and/or transfer stations can be achieved if the vehicles are equipped with d-c motors. Such motors are more sensitive than polyphase current motors and thus require extensive maintenance. Moreover, the control circuitry for such motors is complex and expensive.

It was further proposed to employ mechanical brakes which control the last stages of deceleration of electrically driven vehicles. Such systems are bulky and to expensive for many applications.

OBJECTS OF THE INVENTION

An object of the invention is to provide an electric conveyor whose vehicle or vehicles can be arrested at one or more selected locations with a high degree of accuracy and reproducibility.

Another object of the invention is to provide a novel and improved third rail or live rail for use in the conveyor.

A further object of the invention is to provide novel and improved means for supplying electric current to the third rail.

An additional object of the invention is to provide a novel and improved method of electrically braking the vehicle or vehicles of an electric overhead monorail conveyor.

Still another object of the invention is to provide the conveyor with novel and improved means for rapidly accelerating the vehicle or vehicles.

A further object of the invention is to provide a relatively simple, inexpensive and versatile electrical conveyor which can be put to use in a number of plants as a superior substitute for conventional conveyors.

SUMMARY OF THE INVENTION

The invention is embodied in a conveyor, particularly in an overhead monorail conveyor, which comprises elongated guide means (such as an overhead rail in an assembly plant), at least one vehicle which is suspended on and is movable along the guide means, and novel and improved drive means for moving the vehicle along the guide means. The drive means comprises a third rail or live rail which is adjacent the guide means and includes alternating first and second sections and insulating means between the first and second sections, and electric motor means provided on the vehicle and serving to advance the vehicle along the guide means. The motor means is electrically connected with the third rail, and the drive means further comprises means for supplying higher-frequency current to the first sections and means for supplying lower-frequency current to the second section or sections of the third rail. This renders it possible to bring the vehicle to a predictable halt while the motor means is electrically connected with a second section of the third rail. The insulating means can include means for galvanically separating the first sections from the second section or sections of the third rail.

The vehicle can comprise a follower which tracks the third rail and is electrically connected with the motor means so that the latter can receive higher-frequency current from a first section (by way of the follower) while the vehicle rests in a predetermined position in which the motor means is electrically connected with a second section of the third rail.

The means for supplying lower-frequency current can comprise one or more frequency converters. Such current supplying means can be designed to reduce the frequency of lower-frequency current when the motor means advances beyond a first section of the third rail, i.e., to the next-following second section.

The novel features which are considered as characteristic of the invention are set forth in particular in the appended claims. The improved conveyor itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single Figure of the drawing is a fragmentary schematic elevational view of an electric overhead monorail conveyor which embodies the invention, with the electric motor means of the vehicle located in register with a second section of the third rail.

DESCRIPTION OF PREFERRED EMBODIMENTS

The drawing shows only those parts of an electric monorail conveyor which are necessary for full understanding of the invention. For example, the conveyor may be of the type described in German VDI Guideline No. 3643, draft dated Aug. 1986. An important difference between conventional conveyors and the conveyor of the present invention is in the provision of novel and improved drive means for vehicles 3 (only one shown) which are suspended from and can advance along an elongated guide rail 6. The drive means comprises an electric motor 1 which is mounted on a driver gear 15 and receives current from a third rail or live rail 7. The latter is adjacent the guide rail 6 and includes first sections 9 alternating with one or more second sections 8. The illustrated vehicle 3 further comprises a follower or running gear 2 which tracks the third rail 7 as well as the guide rail 6 and is connected with the driver gear 15 by a horizontal crossbeam 4. The central portion 5 of the beam 4 normally serves as a means for attaching a load thereto so that the load can be transported along the guide rail 6 to a selected location (determined by the second section 8 of the live rail 7) where the vehicle 3 is to be arrested in a predetermined position so that it can be relieved of the load or that it can receive a fresh load.

The reference characters 12 denote those portions of the third rail 7 where the sections 9 are galvanically separated from the section 8, i.e., where the neighboring sections 9, 8, 9 of the illustrated portion of the rail 7 are electrically insulated from each other. The means for supplying higher-frequency polyphase current to the sections 9 of the third rail 7 is shown schematically at 14, and the means for supplying lower-frequency polyphase current to the section 8 of the third rail 7 includes a frequency converter 10. For example, the source 14 can supply current at 380 volts and a frequency of 50 hertz. The frequency of current which is supplied by the converter 10 is less than 50 hertz.

The direction in which the motor 1 can cause the driver gear 15 to advance the vehicle 3 along the guide rail 6 is indicated by the arrow 11. The motor 1 receives current at 380 volts and 50 hertz while the vehicle 3 travels along one of the sections 9 which are connected to the source 14. The connection between the motor 1 and the source 14 is interrupted when the vehicle 3 reaches the insulator 12 at the front end of the respective section 9. The motor 1 then receives current from the frequency converter 10, and the frequency of such current is less than 50 hertz. Furthermore, it is preferred to design the drive means for the vehicle 3 in such a way that the voltage of current which is supplied by the converter 10 is less than that of the current which is supplied by the source 14. The lower voltage and/or lower frequency of current which is supplied by the frequency converter 10 brings about a deceleration of the vehicle 3 which has advanced beyond an insulating portion 12 so that the thus decelerated vehicle can be brought to a full halt with a very high degree of predictability and accuracy, e.g., with a tolerance of ±1 mm from the optimum position. Gradual deceleration of the vehicle which advances along the section 8 of the third rail 7 can be achieved by gradually reducing the frequency of current which is supplied by the converter 10. The frequency can be reduced to a small fraction of the frequency of current which is supplied by the source 14.

In order to ensure that the controls for the motor 1 can receive current while the vehicle 3 is at a standstill or while it advances along a section 8 of the third rail 7, the follower 2 is electrically connected to the third rail and is electrically connected (at 13) with the motor 1. The distance from the follower 2 to the driver gear 15 can be selected in such a way that the follower 2 contacts a section 9 while the motor 1 is located in the region of a section 8. The connection 13 can include or constitute a cable whose conductor or conductors transmit signals to the controls for the motor 1.

If the motor 1 is to be accelerated from zero speed to normal operating speed, the section 8 receives current at 380 volts and 50 hertz so that the vehicle 3 is rapidly accelerated and the driver gear 15 advances across the insulator 12 in front of it to reach the corresponding section 9 of the third rail 7.

An important advantage of the improved conveyor is that the vehicle or vehicles 3 can come to a halt at accurately selected locations even though their drive means employ polyphase current motors. As a rule, the tolerances do not exceed ±2 mm which is approximately ten percent of minimum tolerances which can be achieved with certain presently known motors.

Another important advantage of the improved conveyor is that the solution of ensuring stoppage of the vehicle or vehicles at the selected locations is largely of electrical nature so that the maintenance cost of the drive means is negligible.

A further important advantage of the improved conveyor is that the drive means for the vehicle or vehicles can be incorporated in existing conveyors.

The exact construction of the frequency converter 10 including means for reducing the frequency of supplied current in order to decelerate a vehicle which has reached the section B of the third rail 7 forms no part of the invention. Such frequency converters are available on the market. One of the manufacturers is Strömberg, Se-vaasa (Type SAMi CT 50 002).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A conveyor comprising elongated guide means; at least one vehicle suspended on and movable along said guide means; and drive means for said vehicle comprising a third rail adjacent said guide means and including alternating first and second sections and insulating means provided between said first and second sections and including means for galvanically separating said first sections from said second sections, electric motor means provided on said vehicle and arranged to advance the vehicle along said guide means, said motor means being electrically connected with said third rail, a follower tracking said third rail, the distance of the locus of tracking of the third rail by said follower from the electrical connection between said motor and said third rail being greater than the length of one of said second sections, means for electrically connecting said follower with said motor means, means for supplying higher-frequency current to the first sections of said third rail, and means for supplying lower-frequency current to the second sections of said third rail including means for gradually reducing the frequency of lower-frequency current when said motor means advances from one of said first sections to the adjacent second sections of said third rail.

2. The conveyor of claim 1, wherein said means for supplying lower-frequency current comprises a frequency converter.

3. The conveyor of claim 1, further comprising means for supplying higher-frequency current to the second sections of said third rail for rapid acceleration of vehicles which come to a halt at said second sections.

* * * * *